US011317696B2

(12) United States Patent
Kang

(10) Patent No.: US 11,317,696 B2
(45) Date of Patent: May 3, 2022

(54) MICRO PUMP VESSEL

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 411 days.

(21) Appl. No.: 16/329,994

(22) PCT Filed: Sep. 1, 2017

(86) PCT No.: PCT/KR2017/009603
§ 371 (c)(1),
(2) Date: Mar. 1, 2019

(87) PCT Pub. No.: WO2018/044119
PCT Pub. Date: Mar. 8, 2018

(65) Prior Publication Data

US 2019/0191847 A1 Jun. 27, 2019

(30) Foreign Application Priority Data

Sep. 2, 2016 (KR) ..... 10-2016-0112893

(51) Int. Cl.

| | |
|---|---|
| ***A45D 33/02*** | (2006.01) |
| ***A45D 40/00*** | (2006.01) |
| ***B05B 11/00*** | (2006.01) |
| ***B05B 11/02*** | (2006.01) |

(52) U.S. Cl.
CPC ..... *A45D 40/0075* (2013.01); *A45D 33/025* (2013.01); *B05B 11/00* (2013.01); *B05B 11/025* (2013.01); *B05B 11/3026* (2013.01); *B05B 11/3052* (2013.01); *A45D 2200/055* (2013.01); *A45D 2200/056* (2013.01)

(58) Field of Classification Search
CPC .. A45D 40/0075; A45D 33/025; A45D 33/02; A45D 33/06
See application file for complete search history.

(56) References Cited

FOREIGN PATENT DOCUMENTS

| | | | | |
|---|---|---|---|---|
| CN | 204336134 | U | | 5/2015 |
| JP | 01-091423 | U | | 6/1989 |
| JP | 2016-123845 | A | | 7/2016 |
| KR | 10-2014-0146932 | A | | 12/2014 |
| KR | 20-2015-0002417 | U | | 6/2015 |
| KR | 10-2015-0096609 | A | | 8/2015 |
| KR | 2015/0096609 | | * | 8/2015 |
| KR | 10-1564256 | B1 | | 11/2015 |
| KR | 10-2016-0005242 | A | | 1/2016 |
| KR | 20-2016-0000891 | U | | 3/2016 |
| WO | WO 2015/088100 | | * | 6/2015 |
| WO | 2015-122643 | A1 | | 8/2015 |

OTHER PUBLICATIONS

Machine Translation of Kim et al. (Year: 2015).*

* cited by examiner

*Primary Examiner* — Cris L. Rodriguez
*Assistant Examiner* — Brianne E Kalach
(74) *Attorney, Agent, or Firm* — Novick, Kim & Lee, PLLC; Jae Youn Kim

(57) ABSTRACT

Provided is a pump for discharging cosmetics to the outside while simultaneously opening the outer vessel lid and pushing the discharge plate, which is formed of a smaller number of parts, and thus it is possible to reduce the manufacturing cost.

2 Claims, 4 Drawing Sheets

MICRO PUMP VESSEL

TECHNICAL FIELD

The present invention relates to a micro pump vessel, and more particularly, to a micro pump vessel in which a pump for discharging cosmetics to the outside upon opening the outer vessel lid and pushing the discharge plate is formed of a smaller number of parts so that the manufacturing cost can be reduced.

BACKGROUND ART

In general, a compact container is configured such that a solid powder is accommodated in a container having a predetermined shape and is applied to a face using a powder puff of an application device which is accommodated therein when used.

However, when a solid powder is used as the compact, there are disadvantages that, the solid powder is blown out during use and the feeling of adhesion is somewhat deteriorated when applied to the face.

Therefore, in order to overcome these disadvantages, a compact in a gel state in which a solid powder is mixed with a volatile substance has been developed, and it is a trend that the frequency of use is gradually increasing due to its convenience.

However, the compact in a gel state has a problem in that when exposed to the outside, the volatile substance is blown into the atmosphere and the powder is hardened stiffly or broken due to cracks.

As such, the inner space of the compact has to be hermetically sealed to the outside so that the volatile substance in a gel state is not to be blown out and hardened.

Also, there is also a problem in that high manufacturing cost is incurred due to large number of parts constituting a pump installed inside.

DISCLOSURE

Technical Problem

The present invention has been proposed in order to meet the needs of the above-described prior arts, and it is an aspect of the present invention to provide a micro pump vessel in which a pump for discharging cosmetics to the outside upon opening the outer vessel lid and pushing the discharge plate is formed of a smaller number of parts so that the manufacturing cost can be reduced.

Technical Solution

According to an aspect of the present invention, there is provided a micro pump vessel composed of an outer vessel 10 on one side of which a button 11 is formed and an outer vessel lid 20 which is hinge-coupled to one side of the outer vessel 10 to be opened and closed, including: an inner vessel 30 mounted inside the outer vessel 10; an inner vessel lid 40 which is coupled to an upper portion of the inner vessel 30 at a center of which a cosmetic suction hole 41 is formed; a micro pump 50, which is installed on an upper portion of the inner vessel lid 40 and pumps cosmetic; a circular plate-shaped discharge plate 60, which is inserted and seated on the top surface of the inner vessel lid 40 with the micro pump 50 therebetween, and which discharges and accommodates the cosmetic discharged from the micro pump 50 onto the top surface thereof; a circular plate-shaped member 70 which is seated in a central groove 61 of the top surface of the discharge plate 60 at an upper surface of which a radial groove 71 is formed; a discharge film 80, which is a circular plate-shaped film to cover the entire top surface of the discharge plate 60 and has a plurality of cosmetic discharge holes 81 so as to correspond to the radial groove 71 of the circular plate-shaped member 70; and a ring-shaped fixing member 90 which fixes an edge of the discharge film 80 to the discharge plate 60, an upper portion of which is exposed to the outside to allow a user to make contact using a puff P.

First to third circumferential grooves 62, 63, 64 may be spaced apart at a predetermined interval and be formed sequentially from one having the smallest inner diameter so that the micro pump 50 is mounted on the lower surface of the circular plate-shaped discharge plate 60.

The micro pump 50 may include: a cylindrical rubber sealing cap 51 which is inserted into the first circumferential groove 62 of the discharge plate 60, an upper portion of which is opened and a lower portion thereof is closed, and at a center of which a sheath 51*a* is formed; a housing cap 53 of a cylindrical member, an upper opening of which is inserted between the first circumferential groove 62 and the second circumferential groove 63 of the discharge plate 60, and a check valve 52 is inserted into a lower inner circumference thereof; a piston-type member 54 of a cylindrical member, an upper opening of which is fitted between a lower outer circumference of the rubber sealing cap 51 and the first circumferential groove 62 of the discharge plate 60, wherein a plurality of holes 54*b* are formed around a center portion of a lower surface 54*a*, a contact surface 54*c* is formed so as to extend toward the outside of the lower surface 54*a* to be in close contact with the inner circumference of the housing cap 53, a projection groove 54*d* is formed in the forward and backward directions on a protruding portion protruding at the center of the lower surface 54*a*; and a cylindrical spring 55 provided between the lower surface of the discharge plate 60 and the upper surface of the inner vessel lid 40.

The sheath 51*a* may be positioned at a center of the projection groove 54*d* so that the cosmetic is discharged through the sheath 51*a* opened when the projection groove 54*d* is in contact with the rubber sealing cap 51.

The check valve 52 may be provided with: a central closing portion 52*a* formed at a center so as to be pushed up by a rod 12 protruding from the bottom center of the outer vessel 10; and a plurality of S-shaped connecting members 52*b* for flexibly connecting the outer circumference of the central closing portion 52*a* and the inner circumference of the check valve 52.

Advantageous Effects

According to the micro pump vessel of the present invention, since a pump for discharging cosmetics to the outside while simultaneously opening the outer vessel lid and pushing the discharge plate is formed of a small number of parts, it is possible to reduce the manufacturing cost.

BEST MODE

Figure 1:
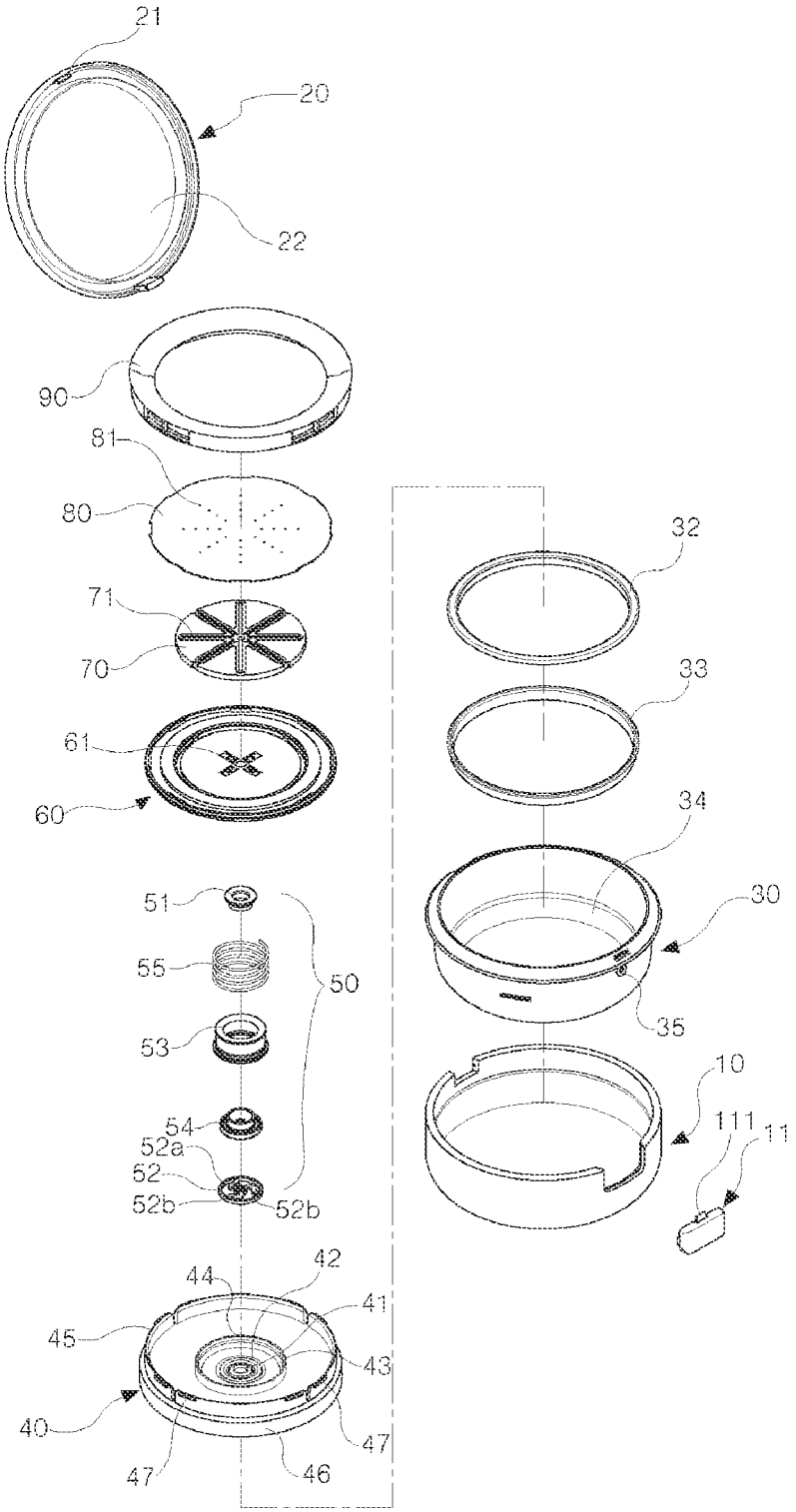
FIG. 1 is an exploded perspective view showing a micro pump vessel of the present invention.

Hereinafter, preferred embodiments of the present invention will be described with reference to the accompanying drawings so that those skilled in the art can easily carry out the present invention. It should be noted that the reference numbers to denote the elements in the attached drawings are used by the same ones even in other drawings for the same elements, if possible.

In the description of the present invention, a detailed description on known functions or known configurations incorporated herein will be omitted when it may make the subject matter of the present invention unclear. And, some elements shown in the drawings are exaggerated, reduced, or simplified for ease of explanation, and the drawings and their components are not necessarily drawn in proper portion. However, those skilled in the art will easily understand these particular matters.

Although the terms including ordinal numbers such as first, second, etc. may be used herein to describe various elements, these elements are not limited by these terms. These terms are used only to distinguish one component from another element. For example, a first component may be referred to as a second component without departing from the scope of claims of the present invention, and similarly, the second component may also be referred to as the first component. As used herein, the term "and/or" includes any and all combinations of one or more of the associated listed items.

In addition, relative terms such as 'front surface'. 'rear surface', 'top surface'. 'lower surface' described on the basis of what is shown in the drawings may be replaced by ordinal numbers such as 'first', 'second.' etc.

The ordinal numbers such as 'first'. 'second', and the like are defined in the order as described or set arbitrarily, and thus the order may be arbitrarily changed as necessary.

The terminology used herein describes only particular embodiments, and the present disclosure is not limited thereby.

As used herein, the singular terms are intended to include the plural forms as well, unless the context clearly indicates otherwise. It will be further understood that the terms "including" or "having", when used in this specification, specify the presence of stated features, integers, steps, operations, components, parts, or combinations thereof but do not preclude the presence or addition of one or more other features, integers, steps, operations, components, parts, or combinations thereof.

Unless defined otherwise, all terms used herein, including technical or scientific terms, have the same meaning as commonly understood by those skilled in the art to which this invention belongs. Terms such as those defined in commonly used dictionaries are to be interpreted as having a meaning consistent with the contextual meaning of the related art but are not to be interpreted as either ideal or overly formal unless clearly defined in the present application.

Hereinafter, preferred embodiments of the present invention will be described in detail with reference to the accompanying drawings. In the description of the present invention, a detailed description on known functions or known configurations incorporated herein will be omitted when it may make the subject matter of the present invention unclear

EMBODIMENT

Figure 2:
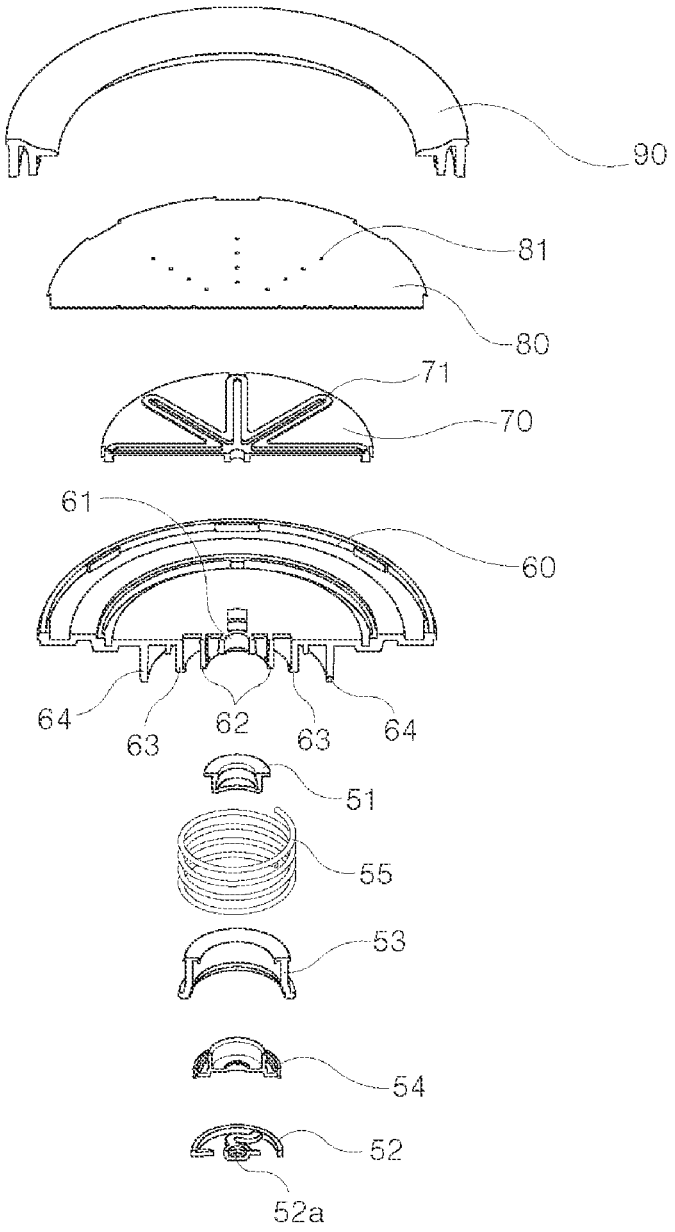
FIG. 2 is an exploded perspective view showing the micro pump vessel of the present invention.
Figure 3:
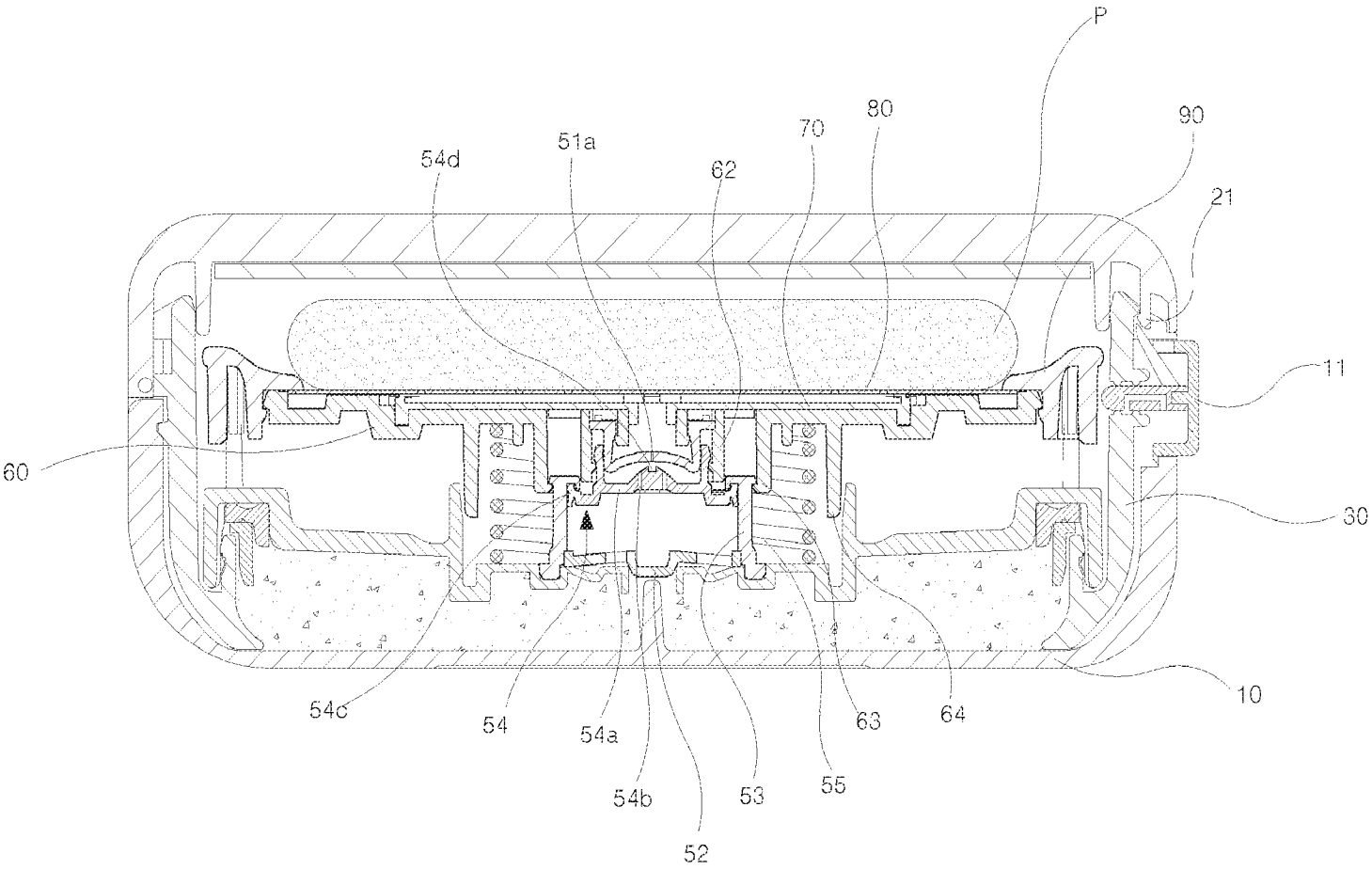
FIG. 3 is an assembled cross-sectional view showing the micro pump vessel of the present invention.
Figure 4:
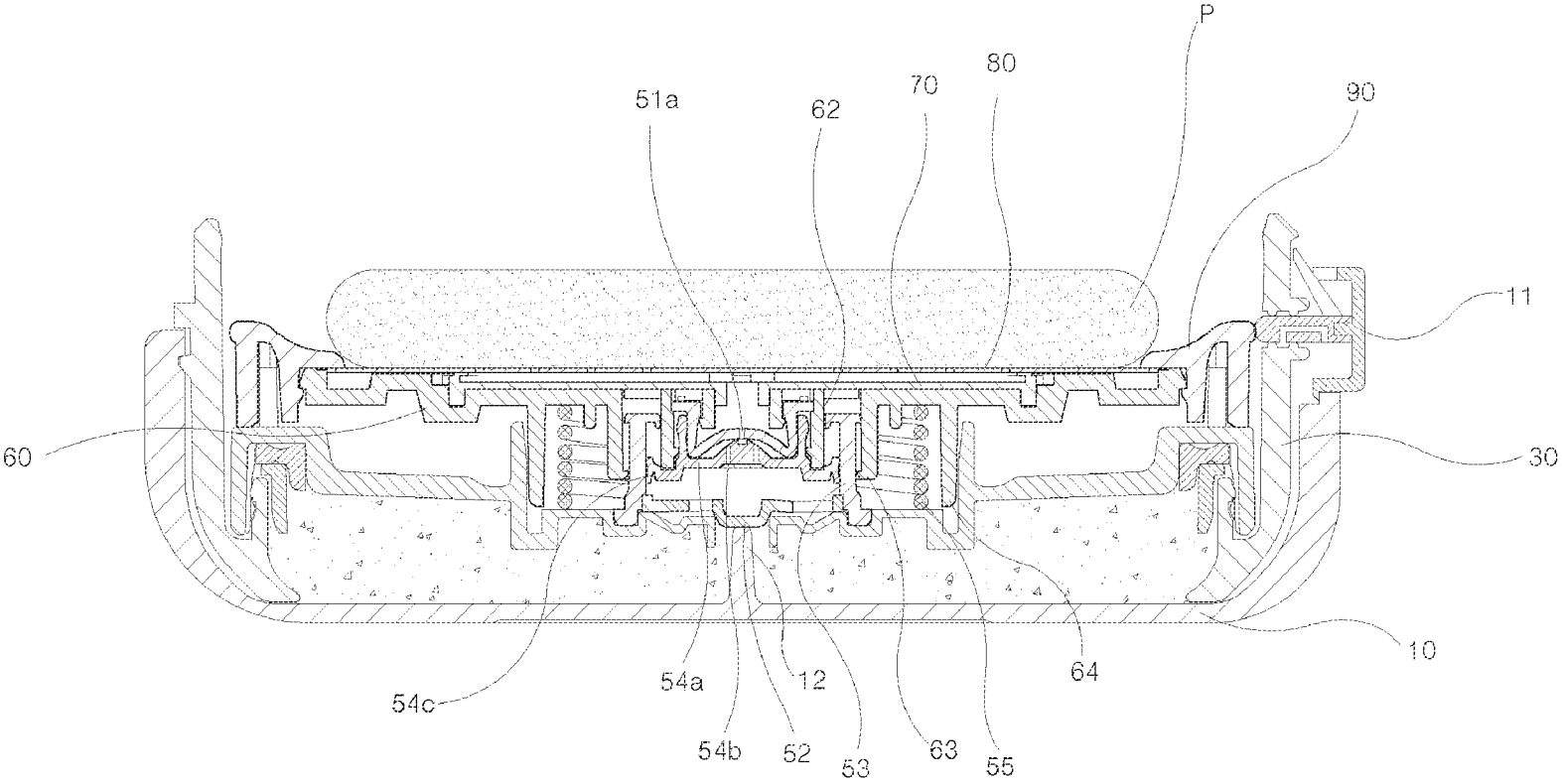
FIG. 4 is an assembled cross-sectional view showing the state when pressing the discharge plate of the micro pump vessel of the present invention.

FIG. 1 is an exploded perspective view showing a micro pump vessel of the present invention. FIG. 2 is an exploded perspective view showing the micro pump vessel of the present invention, FIG. 3 is an assembled cross-sectional view showing the micro pump vessel of the present invention, and FIG. 4 is an assembled cross-sectional view showing the state when pressing the discharge plate of the micro pump vessel of the present invention.

The micro pump vessel according to the present invention, as shown in FIG. 1 to FIG. 4, is composed of an outer vessel 10 on one side of which a button 11 is formed and an outer vessel lid 20 which is hinge-coupled to one side of the outer vessel 10 to be opened and closed, wherein the vessel includes: an inner vessel 30 mounted inside the outer vessel 10; an inner vessel lid 40 which is coupled to an upper portion of the inner vessel 30 at a center of which a cosmetic suction hole 41 is formed; a micro pump 50 which is installed on an upper portion of the inner vessel lid 40 and pumps cosmetics; a circular plate-shaped discharge plate 60 which is inserted and seated on the top surface of the inner vessel lid 40 with the micro pump 50 therebetween, and which discharges and accommodates the cosmetics discharged from the micro pump 50 onto the top surface thereof; a circular plate-shaped member 70 which is seated in a central groove 61 of the top surface of the discharge plate 60 at an upper surface of which a radial groove 71 is formed; a discharge film 80 which is a circular plate-shaped film to cover the entire top surface of the discharge plate 60 and has a plurality of cosmetic discharge holes 81 so as to correspond to the radial groove 71 of the circular plate-shaped member 70; and a ring-shaped fixing member 90 which fixes an edge of the discharge film 80 to the discharge plate 60, an upper portion of which is exposed to the outside to allow a user to make contact using a puff P.

A button 11 is formed on one side of the outer vessel 10, integrally with a slant projection 111 slantly formed on the upper side of the button 11 so that the outer vessel lid 20 is opened by pushing a hook 21 formed on one side thereof by the user's pressing action.

The outer vessel lid 20 serves to open and close the outer vessel 10 on one side of which the protrusion-shaped hook 21 corresponding to the slant projection 111 of the button is formed.

In addition, a mirror 22 is provided inside the outer vessel lid 20 so that the user can easily make cosmetics.

First to third circumferential grooves 62, 63, 64 are spaced apart at a predetermined interval and are formed sequentially from one having the smallest inner diameter so that the micro pump 50 is mounted on the lower surface of the circular plate-shaped discharge plate 60.

The micro pump vessel 50 includes: a cylindrical rubber sealing cap 51 which is inserted into the first circumferential groove 62 of the discharge plate 60, an upper portion of which is opened and a lower portion thereof is closed, and at a center of which a sheath 51*a* is formed; a housing cap 53 of a cylindrical member, an upper opening of which is inserted between the first circumferential groove 62 and the second circumferential groove 63 of the discharge plate 60, and a check valve 52 is inserted into a lower inner circumference thereof; and a piston-type member 54 of a cylindrical member, an upper opening of which is fitted between a lower outer circumference of the rubber sealing cap 51 and the first circumferential groove 62 of the discharge plate 60, wherein a plurality of holes 54*b* are formed around a center portion of a lower surface 54*a*, a contact surface 54*c* is formed so as to extend toward the outside of the lower surface 54*a* to be in close contact with the inner circumference of the housing cap 53, a projection groove 54*d* is formed in the forward and backward directions on a on a protruding portion protruding at the center of the lower surface 54*a*, and a cylindrical spring 55 is provided between the lower surface of the discharge plate 60 and the upper surface of the inner vessel lid 40.

A sheath 51*a* is positioned at a center of the projection groove 54*d* so that the cosmetics is discharged through the sheath 51*a* opened when the projection groove 54*d* is in contact with the rubber sealing cap 51.

The check valve 52 is provided with: a central closing portion 52*a* formed at a center so as to be pushed up by a rod 12 protruding from the bottom center of the outer vessel 10; and a plurality of S-shaped connecting members 52*b* for flexibly connecting the outer circumference of the central closing portion 52*a* and the inner circumference of the check valve 52.

A first sealing ring 32 and a second sealing ring 33 are coupled between the inner vessel 30 and the inner vessel lid 40 to improve the sealing performance of cosmetics in a gel state contained inside the inner vessel 30.

A circumferential coupling protrusion 34 is formed on the inner circumference of the lower side of the inner vessel 30, into which a lower extension protrusion wheel 46 of the inner vessel lid 40 is inserted and coupled thereto.

A first pump mounting groove 42 and a second pump mounting groove 43 on which the micro pump 50 is mounted are spaced apart at a predetermined interval and formed sequentially outside the top surface of the cosmetic suction hole 41 of the inner vessel lid 40.

A first upper extension protrusion wheel 44 is formed extending upward outside the second pump mounting groove 43, a second upper extension protrusion wheel 45 is spaced apart at a predetermined interval, and the lower extension protrusion wheel 46 extends downward and is formed outside the second upper extension protrusion wheel 45.

A fastening protrusion 47 is formed on the upper side of the second upper extension protrusion wheel 45 and a connecting protrusion 48 is formed on the lower inner circumference of the lower extension protrusion wheel 46 and thus is connected with the circumferential coupling protrusion 34.

In addition, a sealing ring insertion groove 49 into which the first sealing ring 32 and the second sealing ring 33 are inserted is formed inside the lower extension protrusion wheel 46.

A method of assembling the micro pump vessel of the present invention as described above will be described as follows.

In order to assemble the micro pump vessel of the present invention, the inner vessel 30 is first fitted to be coupled, and then injected cosmetics into the inner vessel 30.

Next, the inner vessel lid 40 is installed to be fixed to the upper portion of the inner vessel 30 to seal the inner vessel 30. The first and second sealing rings 31 and 32 may be further coupled between the inner vessel 30 and the inner vessel lid 40 to improve the sealing performance.

Thereafter, the micro pump 50 is installed between the inner vessel lid 40 and the discharge plate 60. In detail, a rubber sealing cap 51 on the lower surface of which a sheath 51*a* is formed is inserted into the first circumferential groove 62 of the discharge plate 60, the upper opening of the piston-type member 54 is inserted into the lower outer circumference of the rubber sealing cap 51, and a lower end contact surface 54*c* is inserted and coupled to be in close contact with the inner circumference of the housing cap 53 which is inserted between the first circumferential groove 62 and the second circumferential groove 63.

In order to use the micro pump vessel, first, when the button 11 on the side surface of the vessel is pressed, the hook 21 of the outer vessel lid 20 is pushed up to open the outer vessel lid 20.

In this way, while the outer vessel lid 20 is opened, the discharge plate 60 is pressed by using the puff P.

When the discharge plate 60 is pressed, the cylindrical spring 55 is compressed to lower the housing cap 53, the rod 12 protruding from the center of the bottom of the outer vessel 10 pushes up the central closing portion 52*a*, cosmetics are introduced into the housing cap 53 through spaces among a plurality of S-shaped connecting members 52*b*, these introduced cosmetics are discharged through a plurality of holes 54*b* of the piston type member 54, the rubber sealing cap 52 is in contact with the projection groove 54*d* of piston-type member 54 by lowering of the discharge plate 60 so that the sheath 51*a* is opened, and thereby cosmetics are discharged onto the top surface of the discharge plate 60 (FIG. 4).

As described above, although the present invention has been described in relation to a detailed embodiment of the present invention, it is apparent that those skilled in the art to which the present invention pertains can easily implement by modifying the described embodiments, and these modified embodiments would be included within the technical spirit of the claims of the present invention.

The invention claimed is:

1. A micro pump vessel comprising:

an outer vessel;

an outer vessel lid hinge-coupled to the outer vessel;

an inner vessel disposed inside the outer vessel;

an inner vessel lid coupled to an upper portion of the inner vessel and having a cosmetic suction hole formed therethrough;

a micro pump mounted on an upper portion of the inner vessel lid to pump cosmetics;

a discharge plate seated on a top surface of the inner vessel lid to accommodate the cosmetics discharged from the micro pump, the micro pump being disposed between the inner vessel lid and the discharge plate;

a circular plate-shaped member seated on a top surface of the discharge plate and having a radial groove formed thereon;

a discharge film having a circular plate shape to cover the top surface of the discharge plate and having a plurality of cosmetic discharge holes arranged corresponding to the radial groove of the circular plate-shaped member; and a ring-shaped fixing member configured to fix an edge of the discharge film to the discharge plate, an upper portion of the ring-shaped fixing member being exposed to an outside, wherein the micro pump comprises:

a cylindrical rubber sealing cap configured to be inserted into a first circumferential groove of the discharge plate, having an opened upper portion and a closed lower portion, and having a sheath formed at a center of the closed lower portion;

a housing cap having a cylindrical shape and having an upper opening being inserted between the first circumferential groove and a second circumferential groove of the discharge plate;

a piston member having a cylindrical shape and having an upper opening being fitted between a lower outer circumference of the cylindrical rubber sealing cap and the first circumferential groove of the discharge plate; and a cylindrical spring disposed between a lower surface of the discharge plate and an upper surface of the inner vessel lid, wherein the piston member includes:

a plurality of holes formed around a center portion of the lower surface of the piston member;

a contact surface extending from the lower surface of the piston member to be in contact with an inner circumference of the housing cap; and a projection groove formed on a protruding portion protruding at a center of a lower surface of the piston member, wherein the sheath of the cylindrical rubber sealing cap is positioned corresponding to the projection groove of the piston member and the sheath is configured to be opened when the projection groove is in contact with the rubber sealing cap, such that the cosmetics is discharged through the sheath opened when the projection groove is in contact with the rubber sealing cap.

2. The micro pump vessel of claim 1, wherein the first and second circumferential grooves are spaced apart at a predetermined interval.

* * * * *